United States Patent [19]

Yu et al.

[11] Patent Number: 5,057,041

[45] Date of Patent: Oct. 15, 1991

[54] USER CONFIGURABLE INTEGRATED ELECTRICAL CONNECTOR ASSEMBLY

[75] Inventors: Nobbert N.-H. Yu; Haw-Chan Tan, both of Culver City, Calif.

[73] Assignee: Foxconn International, Sunnyvale, Calif.

[21] Appl. No.: 546,040

[22] Filed: Jun. 29, 1990

[51] Int. Cl.[5] ..... H01R 13/66

[52] U.S. Cl. ..... 439/620; 29/842; 439/609

[58] Field of Search ..... 439/609, 620, 92, 95; 29/842

[56] References Cited

U.S. PATENT DOCUMENTS 4,582,385 4/1986 Couper et al. ..... 439/620 X

*Primary Examiner*—Eugene F. Desmond

*Attorney, Agent, or Firm*—Lyon & Lyon

[57] ABSTRACT

A user configurable integrated electrical connector assembly includes an insulated body comprising a first insulator and a second insulator, respectively, each insulator defining a plurality of passageways extending therethrough for receiving a corresponding electrical contact. A grounding plate is disposed between the first and second insulators transversely to the passageways and has a plurality of projections extending through the passageways for electrically coupling the electrical contacts inserted therein to ground. The grounding plate further comprises a series of parallel extending tabs on its opposed edges. The grounding plate includes a shield portion having a connection to complete ground which entirely covers the front section of the insulated body, thus providing an effective shield against electromagnetic interference. The electrical connector is formed in accordance with a flexible manufacturing system which enables the connector to be completely user configurable. The insulated body, grounding plate and shield cover are first completed and stored in inventory as a semi-finished product. In a second stage of assembly, a user then inserts a plurality of electrical contacts into selected passageways in the insulated body in accordance with its own design specifications. The electrical contacts may contain various integrated electrical circuit components such as capacitors, resistors, varistors, diodes, or the like. Each contact includes a receptacle for receiving and maintaining an electrical component in invariant electrical contact with the projections of the ground plate without bonding or welding, to provide substantially improved protection against electromagnetic and high frequency interference.

38 Claims, 3 Drawing Sheets

USER CONFIGURABLE INTEGRATED ELECTRICAL CONNECTOR ASSEMBLY

BACKGROUND OF THE INVENTION

1. Field Of The Invention

The present invention relates to electrical connector assemblies and particularly to a user configurable connector assembly including a contact defining a receptacle for freely receiving and holding without bonding an integrated filter component for filtering or suppressing the effects of electromagnetic interference or high frequency and radio frequency interference.

2. The Prior Art

Electromagnetic interference or high frequency and radio frequency signals are often radiated or conducted to susceptible electronic equipment and interfere with the performance of that equipment. Such interference is especially prevalent at connection devices. The effects of electromagnetic interference may vary from mere static on a car radio, to a malfunction of an aircraft navigational system. Electromagnetic or high frequency interference may even result in incorrect readouts on sensitive medical diagnostic equipment. Accordingly, it is extremely important to mitigate or to substantially eliminate the effects of electromagnetic or high frequency interference on a wide variety of instruments. There is an increasing need for electrical connectors that provide good filtering capability over a wide range of conditions and uses and which may be user configurable in order to adapt to a variety of interfaces with other equipment.

With regard to filtered connector assemblies, the prior art is characterized by basically four types. The first type of filtered electrical connector employs a monolithic planar capacitor for engaging each electrical contact axially. Examples of this type of electrical connector would include the following: U.S. Pat. No. 4,376,992, U.S. Pat. No. 4,589,720, U.S. Pat. No. 4,653,838, or U.S. Pat. No. 4,710,710.

A second type of electrical connector is characterized by a series of axial contacts and corresponding apertures for coupling the contacts. Each aperture has a capacitor attached around its circumference. The axial contact is inserted through the capacitor. An improvement of this prior art type employs a tubular sleeve capacitor for receiving electrical contact. Examples of this type of filter would include U.S. Pat. No. 3,710,285, U.S. Pat. No. 3,764,943, U.S. Pat. No. 4,020,430, U.S. Pat. No. 4,215,326, U.S. Pat. No. 4,222,626, U.S. Pat. No. 4,265,506, U.S. Pat. No. 4,296,389, U.S. Pat. No. 4,679,013, or U.S. Pat. No. 4,846,732.

A third type of prior art filtered electrical connector uses a "chip" type capacitor to couple with the contact. Examples of this type would include U.S. Pat. No. 4,500,159, or U.S. Pat. No. 4,804,332, or U.S. Pat. No. 4,880,397.

A fourth type of filtered electrical connector of the prior art utilizes a so called "array" type capacitor which provides a planar filter associated with a series of corresponding axial contacts.

There are significant disadvantages associated with prior art filtering electrical connectors. For example, the "array" filters are expensive and somewhat complicated to manufacture. The "feed through" filters using tubular capacitors suffer from problems of strain and deformation due to vibration and applied compressive forces. Because the contacts must be individually soldered or bonded on a plate, this greatly increases the expense of assembly. The tubular type capacitors also are subject to breakdown due to their fragility and are therefore unsuitable for use in harsh operating environments such as motor vehicles, aircraft, or the like, where components will subject to extremes of temperature and vibration. However, other disadvantages associated with this type of connector are the increased cost and complexity of assembly associated with the need for soldering or otherwise individually bonding all the contacts.

Prior art electrical connectors using chip type filter elements such as capacitors suffer from an inherent inflexibility in that they may be limited to only a few rows of terminal connections. This has the disadvantage of a fixed configuration which cannot be reconfigured in accordance with a customer's design specification due to the fact that the capacitors or other filter elements are installed together in a row, and an entire row of capacitors must be inserted at the same time into a bus bar. See, for example, U.S. Pat. No. 4,804,332.

The prior art has the additional disadvantage that the chip filter components such as capacitors must be permanently placed into the internal portion of the connector before final assembly in order to make the connector functional. Thus, in the prior art, it is not possible to manufacture the connector assembly as a semi-finished product and later insert components to configure the finished product in accordance with a customer's design specifications.

For example, in U.S. Pat. No. 4,500,159 all the chip capacitors are assembled in a row of cavities in a bus bar. Each chip capacitor must be in place in a respective cavity prior to final assembly for the connector to be functional. This completely eliminates the possibility of user configurability in accordance with a customer's unique design specifications. A further disadvantage of this type of prior art filtering connector incorporating rows of capacitors is that due to space considerations, this type of filter may be unsuitable for any kind of high density application.

Another example of a prior art electrical connector is U.S. Pat. No. 4,582,385. In this patent, an integrated electrical circuit component such as a chip capacitor is soldered to a contact. The area of the contact around the chip component lacks a sidewall or any means for freely holding the chip component. Because the chip component must be soldered or permanently affixed to the contact, and in addition has no sidewall protection, every applied torsional force or rotational movement of the contact is transmitted directly through the chip. This renders the chip component extremely susceptible to damage due to improper insertion or even a slight twisting of a contact. Thus, the contact disclosed in U.S. Pat. No. 4,582,385 is believed unsuitable for use in a harsh operating environment where the contact will be subject to extreme vibration such as in a motor vehicle, aircraft, or the like.

In the prior art generally, due to the bonded relation between the chip component and the contact, the direct transmission of torsional forces or rotational movement from the contact to the chip can degrade or destroy entirely the bond and thus the continuity of electrical communication between the electrical component and the contact.

Another important limitation of the prior art is the inability to adapt to a variety of user needs, configurations or operating requirements. For example, in U.S. Pat. No. 4,582,385 all the chip components need to be soldered to a contact and inserted into the body of electrical connector prior to final assembly. This precludes the possibility of a flexible manufacturing system which would enable a connector assembly to be fabricated, stored as a semi-finished product, and then configured in accordance with a customer's design specifications.

Previously, many different filter components would have to be permanently bonded to contacts and either assembled as a finished product or held in storage in order to anticipate the needs of a customer. This resulted in the added expense of keeping large quantities of filter connector components or a great variety of electrical connectors in inventory in order to meet a customer's needs. Also, a customer often was forced to use an electrical filter which merely approximated its needs and thus adversely affected the function and cost of an entire apparatus.

This is a wasteful practice and results in the use of connectors which are not adequately suited to a customer's design specifications for the needs of the system, and accordingly, the connectors do not perform filtering functions as adequately as they should.

The prior art devices have the disadvantage that the manufacturer of the electrical connectors must receive instructions from the customer before the product can be fabricated and assembled. This disadvantageously results in a long lead time with respect to the customer. Any delay in the manufacturing of the connector assemblies can severely upset the predetermined schedule of the customer if the connector assemblies are to be a component of the final product such as a computer.

Another problem in the prior art results when a manufacturer of electrical connectors must fabricate and store large numbers of filter connectors having many types of configurations and differing design requirements in order to meet the anticipated needs of customers. While this can avoid the disadvantage of a long lead time, it nevertheless results in problems in keeping track of a large inventory and may also result in a considerable amount of frozen capital investment.

An additional disadvantage inherent in prior art connector devices is the failure to minimize distances between a filtering means such as a capacitor and the connection between the terminal contact and complete ground. This increases the probability of stray inductances and renders many prior art filter connectors completely unsuitable for use in precision instruments. Prior art devices also suffer from a failure to maximize the area connecting complete ground with the terminal contact and the filtering device.

SUMMARY OF THE INVENTION

In order to overcome the foregoing disadvantages of prior art filtered electrical connectors, it is an object of the present invention to provide a user configurable integrated connector assembly at a greatly reduced cost which nevertheless provides improved filtering of electromagnetic interference or stray high frequency signals.

Another object of the invention is to provide a user configurable integrated electrical connector assembly wherein all parts may be assembled as a semi-finished product with the exception of the contacts. The manufacturer or customer may then insert the contacts and selected integrated electrical filter components into the semi-finished product in accordance with its own specifications.

It is a further object of the present invention to provide a contact having a receptacle for receiving and holding an integrated electrical filter component such as a capacitor in the connector passageway without the need for bonding, laser welding, or otherwise fixedly attaching the filter component to the contact. The present contact advantageously is substantially unaffected by vibration and deformation due to strain and applied compressive forces and provides improved electrical contact with ground and thus improved filtering efficiency.

In accordance with these and other objects, the invention provides a user configurable integrated electrical connector assembly comprising an insulated body including a first insulator and a second insulator, respectively, each defining a plurality of passageways extending therethrough for receiving a corresponding electrical terminal contact. A grounding plate is disposed between the first and second insulators and oriented transversely to the passageways. The grounding plate has a plurality of resilient projections extending through the passageways for electrically coupling the electrical contacts inserted therein to ground. The grounding plate further comprises a series of parallel tabs extending outwardly from opposed sides thereof.

A plurality of electrical contacts are provided for selective insertion into the passageways, and each of the contacts includes a receptacle for receiving and holding, without welding or bonding, an integrated electrical filter component such as a capacitor. The unique configuration of the contact, including the receptacle, holds the integrated filter component in invariant electrical contact with the resilient projections of the ground plate.

The invention also provides a flexible manufacturing system which results in a user configurable integrated electrical connector assembly which may be fully assembled in a first stage to form an insert assembly. The insert assembly may be stored as a semi-finished product in inventory. A customer chooses the types of integrated filter components in accordance with its own specifications, and the manufacturer inserts the filter components in the contract receptacles according to the customer's instructions. Finally, the plurality of electrical contacts are selectively inserted into the insert assembly to form the final product in accordance with the customer's own predetermined configuration.

The invention together with further objects and attendant advantages, will be best understood with reference to the following detail description taken in conjunction with the accompanying drawings.

DETAILED DESCRIPTION OF THE INVENTION

Figure 1:
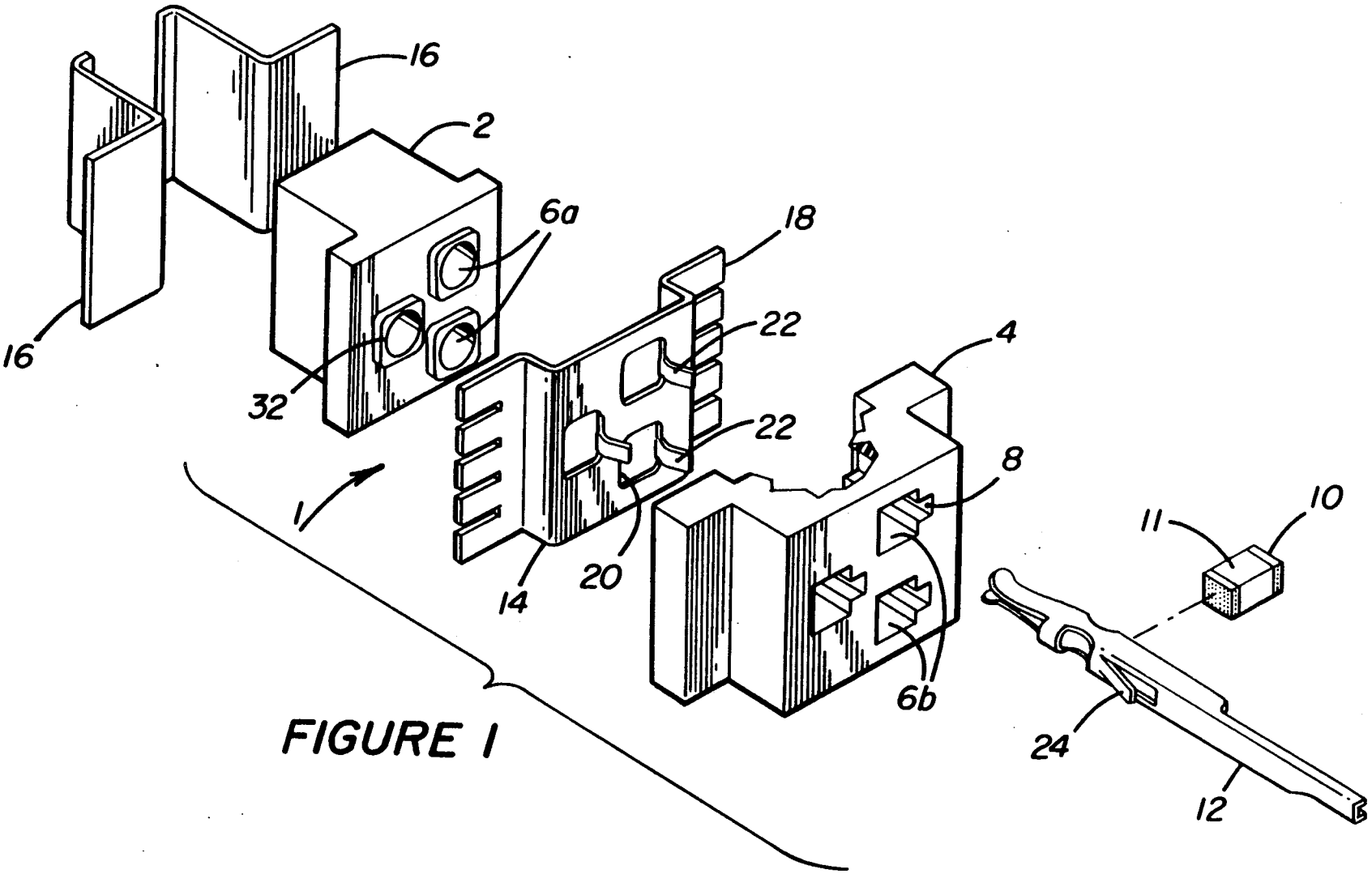
FIG. 1 is a perspective view a presently preferred embodiment of the user configurable integrated electrical connector assembly of this invention.
Figure 2:
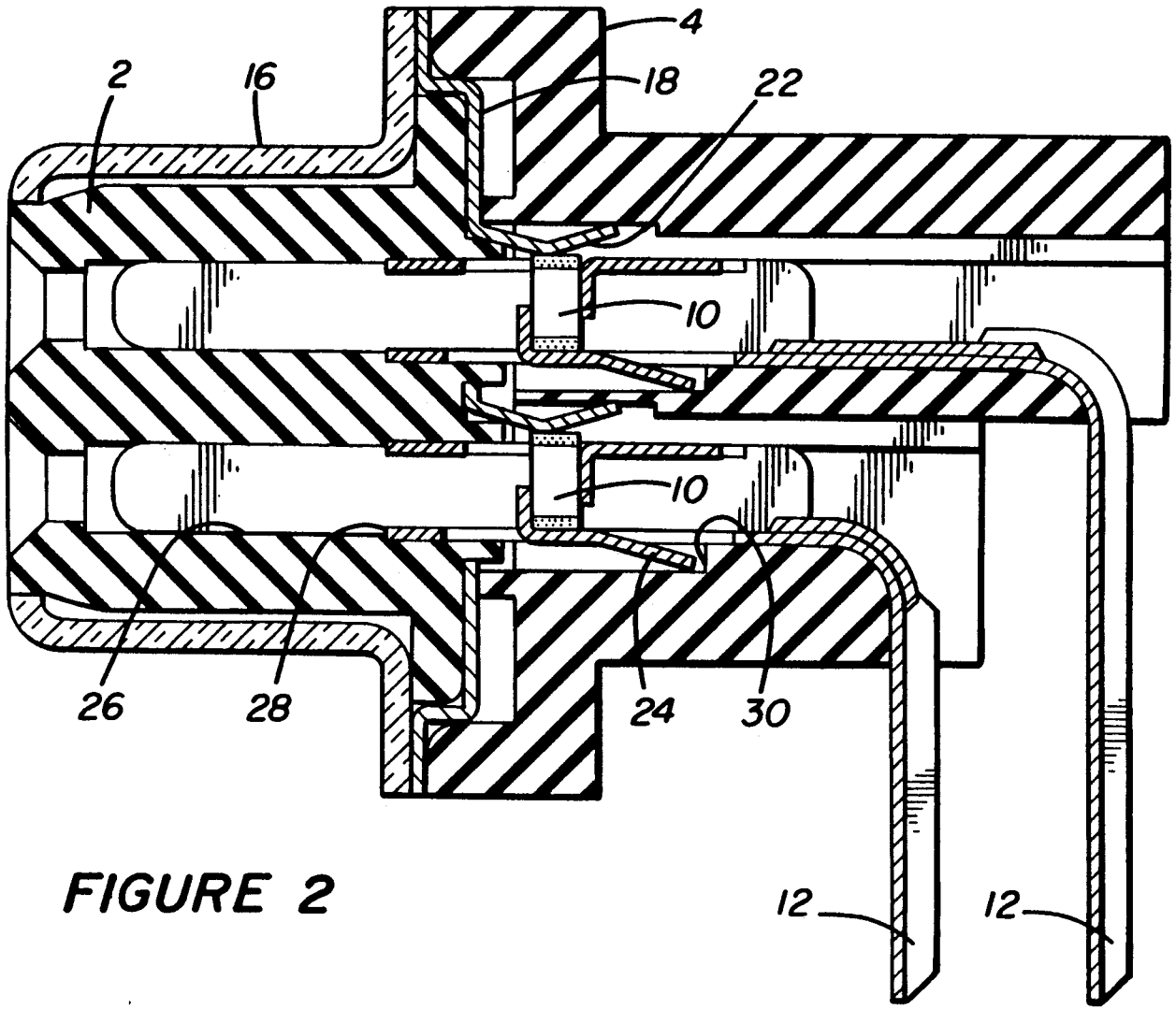
FIG. 2 is a horizontal sectional view of FIG. 1, showing a "right angle" connector configuration.

Referring now to FIGS. 1 and 2, the subject connector 1 includes an insulated body comprising a front insulator 2 and a rear insulator 4. A plurality of passageways 6a, 6b extended axially through front insulator 2 and rear insulator 4, respectively. Each passageway 6b in rear insulator 4 is provided with a recess 8 in an upper portion thereof. Recess 8 is provided for conformably receiving an electrical filter component 10 for suppressing electromagnetic or radio frequency interference. In a preferred embodiment, electrical component 10 comprises an integrated electrical circuit component such as a chip capacitor. Each passageway 6b of rear insulator 4 further is provided with a lower portion 9 which forms a contact space for conformably receiving the cross-section of the contact 12. The contact 12 has a "U" shape in the middle and rear portion and the height of the middle portion is disposed against the entire space 9 of the passageways 6b for increased stabilization of the contact.

A grounding plate 14 is disposed between the front insulator 2 and the rear insulator 4. Grounding plate 14 is electrically coupled to a grounding means 16 by the tabs 18 disposed on the opposite outer edges of grounding plate 14. The grounding means 16 covers the front insulator 2. The grounding means 16 may be a single conductive plate or two plates bonded to the outer sides of front insulator 2 by any convenient method. Grounding means 16 provides a direct electrical connection with ground.

A plurality of apertures or through-holes 20 are provided in the grounding plate 14. Each aperture 20 has a conductive planar projection 22, integral with the body of grounding plate 14, extending from an upper edge of each aperture thereof outwardly into a respective passageway 6b of rear insulator 4. Each projection 22 extends conformably into a corresponding recessed portion 8 of a passageway 6b in order to electrically contact a component 10 which is carried by the contact 12 and slides conformably in each recessed portion 8.

The contact 12 is integrally formed from a single piece of conductive material such as copper. An angular protrusion 24 is provided in a bottom surface of contact 12, opposite the surface of the electrical component 10 which is held in contact with projection 22. To facilitate good electrical contact to ground between the projection 22 of the grounding plate 14 and the electrical component 10 which fits conformably within passageway 6b, the angular protrusion 24 slants outward from the surface of contact 12. However, angular projection 24 may be compressed flush against the surface of contact 12 upon initial insertion of the contact so that it does not interfere with the insertion of contact 12 into a corresponding passageway 6b. Angular protrusion 24 is constructed to have an elastic character so that it resiliently presses outward against the inner surface of passageway 6b which is directly opposite the recessed portion 8. This exerts an upward pressure on the contact 12 and filter component 10. The upward pressure exerted by angular protrusion 24 enhances the electrical contact between the filter component 10, the contact 12 and the downwardly extending projection 22 of grounding plate 14.

Referring to FIG. 2, a step or raised portion 26 is provided in a passageway 6a for confronting the shoulder 28 of the contact 12 in order to stop forward movement of the contact 12. Similarly, a step or raised portion 30 is provided in each passageway 6b for confronting the angular protrusion 24 of the contact 12 in order to prevent any backward movement of the contact 12. As is well known to one of ordinary skill in the art, the contact 12 also may be configured so as to form a "right angle" connector, which may be used with a standard insert assembly as shown.

As shown in FIG. 1, a raised portion or flange 32 is disposed on the surface of the front insulator 2 which is to be in contact with grounding plate 14. Each flange 32 fits conformably within an opening 20 of grounding plate 14 so that the contact 12 will not touch the grounding plate 14 except through the projections 22. That is, a raised flange 32 is provided around the circumference of each corresponding aperture 6a on the surface of front insulator 2 which contacts the grounding plate 14. Each flange 32 fits conformably within a corresponding aperture 20 of the ground plate 14 so as to completely shield the contact 12 from the ground plate 14 when the contact is inserted into the connector body.

As can be seen from FIG. 1 and 2, the contact 12 is integrally formed from a single conductive body. The contact 12 is preferably formed by a stamping process and has a cross-section which is rounded in a first end portion thereof and has a square cross-section in a second end portion. The rounded portion of contact 12 extends conformably into the front insulator 2. The square cross-section of contact 12 extends conformably within the rear insulator 4.

Figure 3:
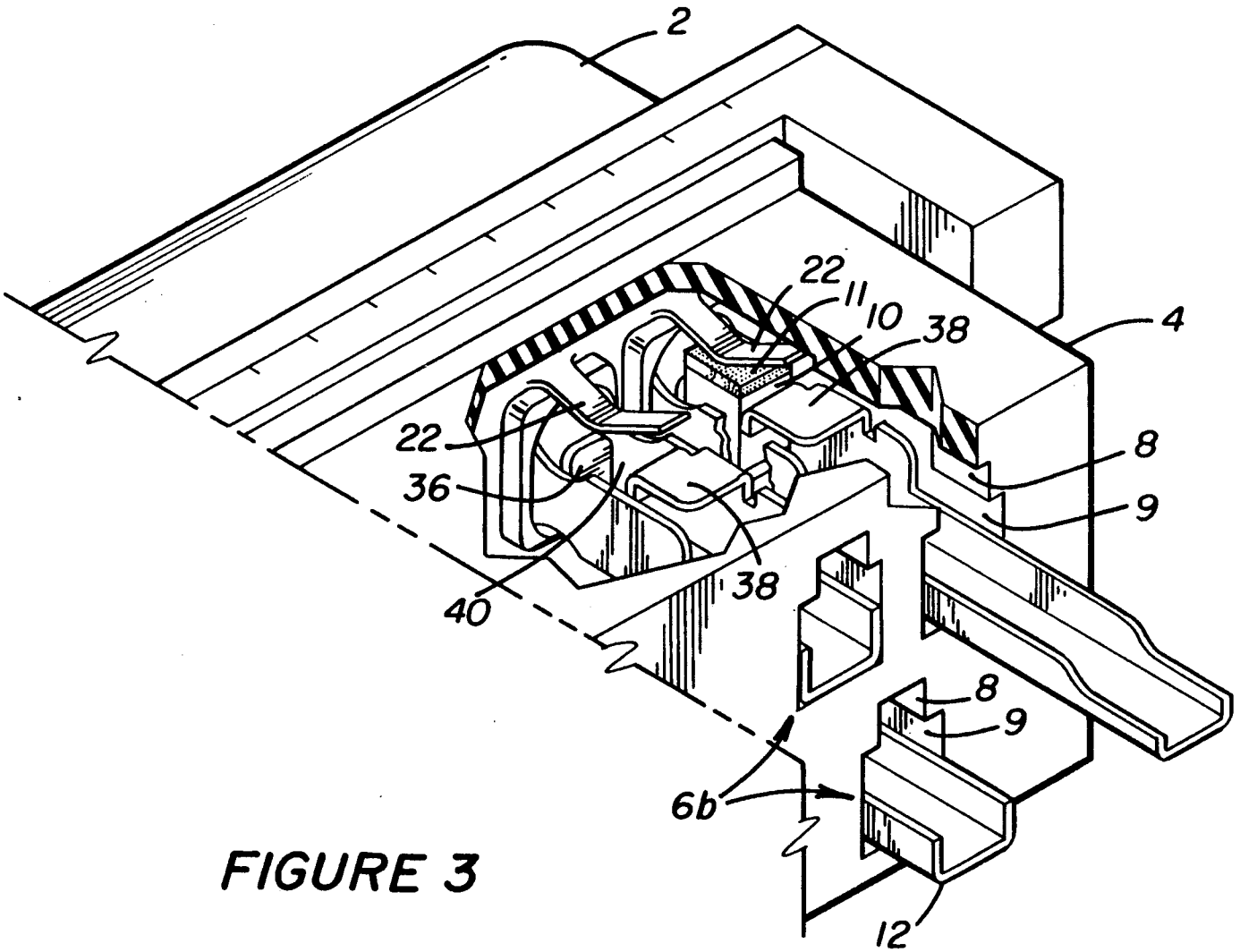
FIG. 3 is a cutaway perspective top view of the electrical contact and receptacle for holding an integrated filter component in accordance with this invention.

FIG. 3 shows details of the structure of contact 12 in a preferred embodiment. In a middle section of the contact 12, some portion of the bottom is preferably stamped upward and bent to form a front fender like portion 36. Similarly, a top portion is stamped downward and bent so as to form a rear fender like portion 38. A recess or receptacle 40 is thereby formed between the two fender portions 36 and 38 for receiving and carrying an electrical component 10.

In a preferred embodiment, the electrical component 10 comprises an integrated electrical circuit component such as a chip capacitor. As is well known by one of ordinary skill in the art, the chip capacitor can be replaced by other chip components, for example resistors, varistors, diodes or other devices formed as an integrated circuit chip which performs different functions. In accordance with the present invention, one can advantageously interchange or even replace these components because they are freely held in the receptacle 40. This would enable the present invention to be used to replace some versatile components without having to replace the entire connector assembly.

Referring again to FIG. 1, in the rear section of contact 12, an angular protrusion 24 may be formed preferably by stamping the base or bottom portion behind the rear fender portion 38. Angular portion 24 is provided for improving electrical contact as explained previously and for confronting the step 30 of a corresponding passageway 6b in which is the contact is inserted.

The rear portion of the contact is configured preferably in a "U" shape as shown in FIG. 3. The "U" shape of the rear portion of the contact advantageously forms two parallel sidewalls for conformably receiving the chip component 10 and for providing lateral stability for holding the chip component 10 without bonding or welding.

It will be appreciated that the electrical component 10 of the present invention is freely positioned in the receptacle 40 and is nevertheless maintained in substantially invariant electrical contact with ground through the projection 22 without being bonded or welded to the contact 12. Other factors which enhance the complete electrical contact with ground of electrical component 10 include the upward pressure exerted by angular extension 24, the downward pressure exerted by projection 22, and the precise orientation provided by recessed portion 8 and steps 26 and 30 which prevent forward or rearward movement of the contact 12. This provides a significant advantage over prior art contacts wherein a filtering component such as a capacitor must be soldered, bonded or otherwise fixedly attached to the contact. Soldered electrical components such as filtering capacitors may undergo severe strain or deformation as a result of vibration or applied compressive forces. Capacitors may even be damaged when inserted into the passageways of prior art connectors. The problem of strain or damage due to deformation is especially significant when a small and delicate component such as a filtering "chip" capacitor must be precisely aligned in order to provide a good electrical contact. The present invention completely eliminates the problems of strain and misalignment associated with a delicate component such as a chip capacitor.

The direction in which electrical contact is formed between the projection 22 of the grounding plate 14 and the electrical component 10 is perpendicular to the insertion direction of the contact into the passageways 6*b* and 6*a*. That is, the capacitor or other electrical component 10 is slidably engaged against projection 22 as the contact 12 is inserted into position. The elongate, resilient projection 22 of grounding plate 14 maintains direct electrical contact with the electrical component 10 along one entire electrode surface 11 as shown in FIG. 3. Because the capacitor or other electrical component 10 is freely held in receptacle 40, this substantially eliminates the problem of breaking electrical continuity with the contact when the chip component 10 is subjected to extreme vibration or applied torsional forces through the rotation or improper insertion of the contact 12.

Furthermore, as will be appreciated from FIG. 3, the projection 22 of ground plane 14 is disposed on the top surface of the passageway to provide a resiliently contact a maximum portion of electrode surface 11 of chip capacitor 10. This is in contrast to prior art contacts which have a cantilevered connection with a ground plane. The contact region between projection 22 of ground plane 14 and the surface of capacitor 10 has an elastic character. A constant pressure is exerted by the projection 22 against the electrode surface 11 of capacitor 10 for superior electrical contact. The elastic character of contact 22 may be appreciated from FIG. 3. It can be seen that although a constant pressure is maintained by projection 22 against capacitor 10, projection 22 is nevertheless resilient enough to substantially eliminate the problem of breaking or damaging the chip component 10 in the presence of upward vibration or applied torsional forces or rotational movement.

This provides an economic advantage over the prior art in that the contact 12 may be associated with a delicate electrical component 10 such as a chip capacitor which is inserted freely, without any kind of bonding, into the conductive body of the contact itself. The present invention therefore achieves superior electrical contact with ground and an electrical component without the necessity of soldering or other forms of bonding such as laser welding which can be expensive and can greatly increase manufacturing costs. Soldering also may pose a risk of damage to small chip capacitor by exposing it to high temperature.

It will be appreciated that the electrical component 10 such as a capacitor may be replaced by other integrated electrical circuit components used for other functions such as resistors, varistors, diodes, or other chip components.

It will be appreciated that an improved direct electrical contact is achieved through projection 22 resiliently contacting electrical component 10 in combination with the pressure exerted by projection 24. The constant electrical communication between the electrical component 10 and the grounding plate 14 through projections 22 may facilitate the removal of high frequency interference.

A further advantage of the preferred embodiment is provided by the transverse orientation of the grounding plate 14 to the contacts 12. The provision of grounding plate 14 between the front and rear insulators 2 and 4, respectively also advantageously functions to separate the passing of interfering signals in and out of the connector body and provides an extremely good shielding effect.

As seen from FIG. 1, the grounding means 16 is a conductive element having a direct contact with ground. The grounding means 16 may be configured to completely cover the outside surface of the front insulator 2. This provides an extremely effective shield against electromagnetic interference.

The grounding plate 14 is advantageously maintained in a maximized contact area with the grounding means 16 by means of the configuration of grounding tabs 18. As shown in FIG. 2, grounding tabs 18 are maintained flush against grounding means 16 so as to completely shield front insulator 2. Every contact 12 is further shielded from interference by capacitor 10 which is connected through projection 22 to the grounding plate 14 and grounding means 16. This provides an effective filter against interfering signals.

The connection of the electrical component 10, grounding plate 14 and grounding means 16 occurs in close proximity with every contact 12. That is, the distance to complete ground provided by grounding means 16 is minimized by the configuration of the present invention. This provides an enhanced, more complete grounding effect.

In the prior art, the grounding effect is often provided by screws placed at opposite sides of the connector. The prior art disregards the distance between the filtering capacitor and complete ground and therefore the distance to complete ground is considerably longer than in the present invention. This increases the probability of stray inductances that may cause significant interference. The present invention prevents or substantially reduces the chance of stray inductance by maximizing the area of the electrical contact between the grounding means 14 and grounding plate 16 and by minimizing the distance between the filtering capacitor 10, the grounding means 14 and complete ground.

In accordance with another important aspect of this invention, a flexible manufacturing system is provided wherein a connector assembly may be fully manufactured in a first stage and stored in inventory as an "insert assembly." In a second stage, final customer configuration takes place according to a customer's precise design requirements. It will be appreciated that this was not possible in the prior art because the chip capacitors had to be individually welded, soldered or otherwise bonded to the contacts before final assembly of the connector. This completely precluded the possibility of customer configuration to meet specific design requirements.

With regard to the present flexible manufacturing system, the configuration of the contact 12 enables an electrical component 10, such as a capacitor, to be selectively inserted into any of the passageways 6*a*, 6*b* in order to configure a connector precisely in accordance with a customer's specifications. The flexible manufacturing system according to the present invention enables the particular arrangement of electrical contacts to be determined completely by the user, even after assembly of the connector.

In the assembly process, the front insulator 2, the rear insulator 4, the grounding plate 18 and the grounding means 16 are put together first as a semi-finished product, termed an insert assembly, which may be stored indefinitely as inventory. Upon receiving a customer's order, and in accordance with each customer's unique needs, the contacts 12 may be associated with a selected capacitor or other desired electrical filter component as required. This process places the electrical component 10 such as a chip capacitor along its electrode direction into the receptacle 40 of the contact 12. The contacts 12, together with their associated electrical components 10 may then be selectively inserted through selected passageways 6*b* of the rear insulator 4 in an upright position. That is, the top of component 10, such as, for example, an electrode surface of a chip capacitor, moves forward along the recess 8 of passageway 6*b* and then automatically aligns with and is placed in electrical contact against the projection 22 of grounding plate 14. When the contact 12 reaches its designated position, the shoulder 28 of the contact 12 will confront the step 26 of the passageway 6*a*. Simultaneously, the angular protrusion 24 will also confront the step 30 of passageway 6*b*.

In summary, the present invention also provides a flexible manufacturing system wherein a filtered electrical connector assembly may be manufactured in two stages. In a first stage, an insert assembly is fully formed and may be stored in inventory as a semi-finished product. In the final stage, the fully formed insert assembly may be individually customized or configured in accordance with each customer's unique requirements and design specifications merely by inserting contacts and associated, freely held chip components into selected passageways of the insert assembly.

This provides an extremely efficient method from both a time and cost standpoint of enabling an electrical component such as a chip capacitor to be freely inserted in a finished connector assembly and maintained in a substantially invariant and maximized electrical communication with a grounding plate and with a contact without soldering, bonding or laser welding. Accordingly, the present flexible manufacturing system enables a semi-finished connector assembly to be stored in inventory and subsequently easily configured in accordance with the customer's precise design specifications.

This aspect of the present invention is believed to provide a significant advantage over prior art connectors wherein filtering components such as chip capacitors must be soldered, bonded or otherwise fixedly attached to the contact itself and wherein the entire connector assembly must be assembled all at once in order to be functional, thus completely eliminating the possibility of user configurability.

It will be appreciated that the angular protrusion 24 does not affect the sliding resistance of the contact 12 through the passageways 6*a* and 6*b*. That is, the angular protrusion 12 merely depresses during insertion until it reaches a point with enough space to spring outwardly against the inner surface of passageway 6*b* as shown in FIG. 2. Angular protrusion 24 facilitates the proper orientation of the contact 12 of within the passageway 6*a* and 6*b*. At the same time, the angular protrusion 24 pressing outwardly against the inner surface of passageway of 6*b* also provides a resilient upward pressure directly against the capacitor 10 and enhances its electrical contact with projection 22 of the grounding plate 14.

In a preferred embodiment, there may be an embossed or raised portion provided on the supporting surface of the receptacle 40 of the contact 12 in order to further improve the degree of electrical communication between the capacitor 10, projection 22 and the contact 12.

In a preferred embodiment, the front fender portion 36 of the contact 12, the rear portion 38 and angular protrusion 24 may advantageously be formed from a single piece of metal by a stamping process as the contact 12 is formed. A stamping process is used to provide a contact having a base, a top, and opposed sides forming a generally U shaped configuration. The receptacle for holding the integrated electrical component is formed by bending a bottom portion upward to form a front fender. A top portion is then bent downward to form a rear fender. The front and rear fender portions define the front and rear ends of a receptacle. The U shaped side portions define the sides of the receptacle. It will be appreciated that a receptacle formed by this method advantageously may be sized so as to hold a capacitor or other integrated circuit device in a substantially invariant position without the need for bonding, soldering or laser welding. This provides an integral, one piece, yet multifunctional electrical contact 12 which may be simply manufactured from a single piece of metal.

An important benefit of the present invention is the low cost of producing a connector as described herein. The configuration of the contact 12 enables the present invention to use "chip" or fully integrated capacitors 10 instead of an array or tubular capacitor as is commonly used in the prior art. The chip type capacitor is much less expensive than any other type. Moreover, the integral construction of the contact, formed by a stamping process from a single piece of metal, also substantially reduces the cost of manufacturing the contact. The contact receptacle for holding the chip capacitor without bonding, soldering or laser welding further reduces cost and complexity. The present invention thus provides a much simplified electrical connector with a minimum number of components. This results in a greatly reduced overall cost for a connector without any loss in filtering capacity. For the reasons stated above, the filtering effect of the present connector against interfering signals, particularly high frequency signals, is superior in comparison to prior art devices.

Another advantage is that the flexible manufacturing system provided by the present invention also shortens the lead time necessary for customizing a connector because the connector may be manufactured as a semi-finished product, an "insert assembly", and stored as inventory. Once the manufacturer has received a customer's order, the insert assembly may be configured in accordance with the customer's exact requirements merely by inserting the contacts accompanied with specific capacitors or other integrated filter components into the finished connector. This provides an extremely efficient method both from a time and cost standpoint of configuring the final product.

It will be appreciated that the structure of the connector according to the present invention enables any number of passageways to be provided in the front or rear insulators. Three passageways are shown merely for the sake of illustration. In fact, high density multiple row contacts can be provided by using smaller chip capacitors. In contrast, the prior art could not achieve high density multiple row contacts due to the limitations inherent in many prior art structures wherein the chip capacitors are installed in a bus assembly which limits the available space and the number of contacts.

In conclusion, the details of the present invention provide a novel structure for a connector which may be completely user figurable. While the invention has been described in connection with what is presently considered to be the most practical and preferred embodiments, it is to be understood that the invention is not limited to the disclosed embodiment but, on the contrary is intended to cover various modifications and equivalent arrangements included within the spirit and scope of the appended claims.

What is claimed is:

1. A user configurable integrated electrical connector assembly comprising:

an insulated body having a plurality of passageways extending therethrough;

a grounding means disposed transversely to said passageways, having a plurality of projections for engagement with the interior of said passageways, a plurality of electrical contacts for insertion in selected ones of said passageways, each contact being integrally formed from a single conductor and including a receptacle means having a base and at least two sidewalls disposed for conformably receiving and maintaining an integrated electrical filter component in invariant electrical contact with said projections.

2. The connector assembly as described in claim 1 wherein said insulated body includes a front insulator and a rear insulator.

3. The connector assembly as described in claim 2 wherein said grounding means includes a grounding plate mounted between said front insulator and said rear insulator and a conductive member having a connection with ground electrically coupled to said grounding plate such that the distance between said grounding plate and complete ground is minimized.

4. The connector assembly as described in claim 3 wherein said grounding plate further comprises a series of parallel tabs disposed on opposite sides thereof.

5. The connector assembly as described in claim 4 wherein said grounding plate further defines a plurality of apertures corresponding to said passageways, and includes a plurality of corresponding projections extending from a top portion of each aperture and into the interior of a corresponding passage in said rear insulator for electrically coupling with a corresponding integrated electrical component inserted therein.

6. The connector assembly as described in claim 5 wherein each projection has a generally curved shape and a distal end disposed against the top surface of said passageway for exerting a constant pressure against said electrical component.

7. The connector assembly as described in claim 5 wherein said surface of said front insulator adjacent said grounding plate includes a plurality of raised flanges corresponding to each of said passageways.

8. The connector assembly as described in claim 7 wherein said flanges fit conformably within each corresponding aperture of said grounding plate and said grounding plate is disposed over said front insulator.

9. The connector assembly as described in claim 6 wherein each passageway in said front insulator and in said rear insulator has a step therein for proper positioning of an electrical contact inserted therein.

10. The connector assembly as described in claim 9 wherein said electrical contact is characterized by an integral conductor body having a top, a base and opposing sides, said contact being characterized by a round front section, a square rear section and a middle section wherein a portion of the base is bent upwardly to form a front fender and a portion of top is bent downward to form a rear fender to define a receptacle between said front and rear fenders for conformably receiving and holding an integrated electrical component.

11. The connector assembly as described in claim 10 wherein said electrical contact includes an angular portion protruding from said base and resiliently disposed against the interior surface of said passageway for maintaining invariant electrical contact between said electrical filter component and said projection of said grounding plate.

12. The connector assembly as described in claim 10 wherein said electrical component comprises a capacitor, resistor, varistor, diode, or other integrated circuit filter component.

13. A user configurable integrated electrical connector assembly comprising:

an insulated body having a plurality of passageways extending therethrough;

a grounding means including a grounding plate disposed transversely to said passageways and having a plurality of corresponding sections for engagement with each passageway;

receptacle means disposed in a corresponding one of a plurality of electrical contacts selectively insertible in selected passageways in accordance with a particular user configuration, each receptacle means having a base and at least two sidewalls for freely receiving an integrated electrical component and for conformably maintaining said component in substantially invariant electrical contact with said sections of said grounding means without bonding.

14. The connector assembly as described in claim 13 wherein said insulated body comprises a front insulator and a rear insulator.

15. The connector assembly as described in claim 14 wherein said grounding means includes a grounding plate disposed between said front insulator and said rear insulator.

16. The connector assembly as described in claim 15 wherein said grounding means further includes a plate having a connection with ground which covers said front insulator and electrically contacts said grounding plate.

17. The connector assembly as described in claim 16 wherein said grounding plate defines a plurality of apertures corresponding to said passageways and further includes a plurality of projections extending into each corresponding passageway of said rear insulator for coupling an electrical component inserted in said passageway to ground.

18. The connector assembly as described in claim 17 wherein each projection of said grounding plate is curved downward into the interior said passageway and has its distal end disposed against the surface of said passageway.

19. The connector assembly as described in claim 18 wherein each passageway in said front insulator terminates in a raised flange which is conformably received within a corresponding aperture of said grounding plate.

20. The connector assembly as described in claim 19 wherein each passageway in said front insulator and said rear insulator has a raised portion on the interior surface thereof for stopping the forward and rearward movement, respectively, of an electrical contact inserted therein.

21. The connector assembly as described in claim 20 wherein said electrical contact is integrally formed from a single conductor and includes a receptacle formed in middle portion thereof for receiving and carrying an electrical component in invariant contact with said projection of said grounding plate.

22. A user configurable electrical connector assembly comprising:

an insulated body having a plurality of passageways extending therethrough;

at least one grounding plate disposed transversely to said passageways, said grounding plate having a plurality of protruding sections engaging with an inner surface of said passageway;

a grounding means coupling said grounding plate to ground;

a plurality of electrical contacts for selective insertion in said passageways, each electrical contact having at least one receptacle means including sidewall portions for freely receiving and for conformably maintaining without bonding at least one electrical component inserted therein invariant electrical contact with said protruding sections.

23. An electrical contact for selective insertion in selected ones of a plurality of passageway in a user configurable connector assembly comprising:

a conductor body having a base, top and parallel, opposed side portions;

a front fender extending upwardly from the base;

a rear fender extending downwardly from the top portion, said front and rear fenders defining a receptacle for receiving and carrying a selected integrated electrical filter component.

24. The electrical contact as described in claim 23 wherein said contact includes an angular protrusion projecting from said base for slidably engaging the inner surface of a selected passageway.

25. A contact as described in claim 24 wherein said contact in further characterized by a generally U-shaped cross-section including a front portion that is round and a rear portion that is square and wherein said front portion functions as a receptacle.

26. The contact as described in claim 24 wherein said contact is further characterized by a generally U shaped cross-section including a front portion that is round and a rear portion that is square and wherein said front portion functions as a plug.

27. A user configurable integrated electrical connector assembly comprising:

an insulated body including a front insulator and a rear insulator respectively, each defining a plurality of passageways extending therethrough, said front insulator further having a plurality of flanges disposed around the passageways on its surface facing said rear insulator and each of said passageways in said front and rear insulators having at least one step provided therein for guiding and maintaining the proper position and orientation of an electrical contact inserted therein;

a grounding plate disposed between said front insulator and said rear insulator and transversely to said passageways, having a plurality of apertures corresponding to each of said passageways and for conformably receiving said flanges of said front insulator, and wherein a plurality of projections extend from the upper edge of said apertures into corresponding passageways of said rear insulator and including a plurality of parallel extending tabs disposed on opposite edges of said grounding plate;

a grounding means covering said front insulator and coupling said grounding plate to ground;

a plurality of electrical contacts for selective insertion in said passageways each contact having a round front portion, a rear square portion, and a generally U shaped middle portion including a front fender and a rear fender, respectively, for defining a receptacle in said U shaped portion for maintaining an electrical component in substantially invariant contact with the projections of said ground plate, said electrical contact further including a shoulder in the front portion thereof for confronting the step of said front insulator and an angular protrusion behind said rear fender, extending downward for confronting said step of said rear insulator.

28. The connector assembly as described in claim 27 wherein said contact has a body having a generally U shaped cross-section and said passageways of said rear insulator are congruently shaped for conformably receiving said connectors.

29. A method of assembling an integrated electrical connector assembly in accordance with a user's desired configuration comprising the steps of:

a. molding a front insulator and a rear insulator; to define a plurality of passageways therein;

b. stamping a grounding plate to define a plurality of passageways corresponding to the passageways in the insulators;

c. stamping a plurality of electrical contacts to define at least one receptacle in each contact for freely receiving and for holding an electrical component inserted therein in substantially invariant electrical communication with said grounding plate;

d. assembling the front insulator, the grounding plate and the rear insulator with the grounding plate disposed transversely between the insulators;

e. providing a grounding shield over at least the front insulator and contacting the grounding plate to form a one piece semi-finished product for storage in inventory;

f. inserting desired electrical components in selected electrical contacts; and inserting desired electrical contacts and their associated components into selected passageways in accordance with the instructions of a customer.

30. A method of assembling an integrated electrical connector assembly in accordance with claim 29 wherein said step of stamping said electrical contacts includes the following steps:

stamping a one piece conductor into a body having a base, a top and opposed sides;

defining a component carrying receptacle therein by stamping a portion of the base and bending it upward to form a front fender, and stamping a portion of the top and bending it downward to form a rear fender;

stamping a shoulder in the front portion for confronting the front insulator;

stamping an angular protrusion behind the rear fender for confronting the rear insulator;

bending the sides of the front portion to form a round cross-section;

bending the sides of the rear portion to form a square cross-section.

31. A user configurable integrated electrical connector comprising:

an insulated body including a first insulator and a second insulator, respectively, each defining a plurality of passageways extending therethrough;

a grounding plate disposed between said first and second insulators transversely to said passageways, said grounding plate having a plurality of projections each extending through a corresponding passageway for providing an electrical coupling to ground, said grounding plate further comprising a series of parallel extending tabs on opposed outer sides thereof;

a plurality of contacts for insertion into selected passageways, each of said contacts defining a receptacle in a portion thereof for freely receiving and holding an integrated electrical component such as a capacitor, resistor, varistor, diode, or other integrated circuit filter components in substantially invariant electrical contact with a corresponding projection of said ground plate.

32. A one-piece electrical contact for selective insertion into selected ones of a plurality of apertures to form a user configurable connector assembly, said contact comprising a receptacle means having a base and surrounding sidewalls for freely receiving and for conformably holding without bonding a selected integrated electrical component inserted therein.

33. An electrical contact according to claim 32 wherein said contact comprises a base and at least one side wall portion extending upwardly from said base, a top portion, and wherein said receptacle is defined by two proximally opposed fender portions which are formed from said side wall or top portion.

34. A flexible manufacturing method for producing a user configurable electrical connector assembly comprising the following steps:

assembling as a semi-finished product for storage in inventory an insert assembly comprising an insulated body including a front insulator and a rear insulator, each having a plurality of passageways extending therethrough, for receiving a plurality of contacts and a grounding means disposed between said front insulator and said rear insulator and transversely to said passageways, said grounding means including a conductive shield covering at least one front insulator;

stamping a contact to provide a U shaped cross section for defining at least one receptacle for freely receiving and holding an electrical component inserted therein;

storing in inventory a quantity of insert assemblies, contacts and selected electrical components for performing different functions;

inserting desired electrical components in said contacts; and inserting said contacts and their associated electrical components in selected passageways in said insert assembly for producing a final product in accordance with a customer's design specifications.

35. A method of flexible manufacturing of an electrical connector assembly to create a user configurable connector assembly including the steps of:

defining a plurality of passageways therethrough a first insulator;

defining a plurality of passageways extending through a second insulator corresponding to said first passageways;

disposing between said first and second insulators and transversely to said passageways a ground plate having a plurality of through holes corresponding to said passageways;

providing a conductive shield over at least said first insulator and coupling said conductive shield with said ground plate;

attaching said conductive shield, first insulator, grounding plate and second insulator together to form an integral unit for storage in inventory;

providing a plurality of contacts, each having at least a base, a top and at least one sidewall for defining at least one receptacle for receiving a freely insertible associated electrical component;

inserting desired electrical components into said contacts and selectively inserting said contacts and their associated electrical components into selected ones of said passageways to thereby create a user configurable electrical connector.

36. An electrical contact for selective insertion into selected ones of a plurality of passageways to form a user configurable connector assembly, said contact defining a receptacle means for freely receiving and for conformably holding a selected integrated electrical component inserted therein without bonding, wherein said contact comprises a base and at least one sidewall portion extending upwardly from said base, and a top portion, and wherein said receptacle means is further defined by two proximally opposed fender portions which are formed from said sidewall or top portion.

37. A user configurable electrical connector assembly comprising:

an insulated body having a plurality of passageways extending therethrough;

at least one grounding plate disposed transversely to said passageways, said grounding plate having a plurality of protruding section engaging with an inner surface of said passageway;

a grounding means for coupling said grounding plate to ground;

a plurality of electrical contacts for selective insertion in said passageways;

receptacle means disposed in each electrical contact for receiving and for conformably holding an electrical filter component in invariant electrical contact with said protruding sections, said receptacle means including a front portion, a rear portion and two sidewalls forming a containment portion for congruently contacting said electrical filter component.

38. An electrical contact for selective insertion in selected ones of a plurality of passageways in a user configurable connector assembly, characterized by a receptacle means for conformably receiving and for holding an electrical component without bonding, said receptacle means including a base, and corresponding surrounding walls for defining a containment region for conformably holding a congruently shaped electrical component and for shielding said electrical component against applied torsional forces.

* * * * *